US010672302B1

(12) United States Patent
Schultz et al.

(10) Patent No.: US 10,672,302 B1
(45) Date of Patent: Jun. 2, 2020

(54) ENDCAP HEADER ASSEMBLY AND ASSOCIATED METHODS

(71) Applicant: TARGET BRANDS, INC., Minneapolis, MN (US)

(72) Inventors: Cory Schultz, Minneapolis, MN (US); David Cheney, New Brighton, MN (US); Ryan Lake, Saint Paul, MN (US); Robert G. Logan, Blaine, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 16/237,597

(22) Filed: Dec. 31, 2018

(51) Int. Cl.

| | |
|---|---|
| ***G09F 3/00*** | (2006.01) |
| ***G09F 3/20*** | (2006.01) |
| ***G09F 7/10*** | (2006.01) |
| ***A47F 5/08*** | (2006.01) |
| ***A47F 5/10*** | (2006.01) |
| ***G09F 7/20*** | (2006.01) |
| *A47F 5/00* | (2006.01) |

(52) U.S. Cl.
CPC ..... *G09F 3/204* (2013.01); *A47F 5/0846* (2013.01); *A47F 5/101* (2013.01); *G09F 7/10* (2013.01); *G09F 7/20* (2013.01); *A47F 2005/0075* (2013.01)

(58) Field of Classification Search
CPC ... G09F 3/204; G09F 7/20; G09F 7/10; A47F 5/101; A47F 5/0846; A47F 2005/0075
See application file for complete search history.

(56) References Cited

U.S. PATENT DOCUMENTS

| | | | | |
|---|---|---|---|---|
| 1,943,295 | A | 1/1934 | Block | |
| 2,388,180 | A | 10/1945 | Pulver, Jr. | |
| 4,319,417 | A | 3/1982 | Schimmel | |
| 4,344,244 | A * | 8/1982 | Tyke | G09F 7/02 40/490 |

(Continued)

OTHER PUBLICATIONS

"Gondola Shelving End Cap Sign Holder & Brackets, Spiral Pads, 12×36W", printed from www.dgsretail.com/P8616/Gondola-Shelving-End-Cap-Sign-Holder, publicly available at least as early as Jan. 18, 2016, per http://web.acrhive.org (12 pages).

(Continued)

*Primary Examiner* — Cassandra Davis
(74) *Attorney, Agent, or Firm* — JoAnn M. Seaton; Griffiths & Seaton PLLC

(57) ABSTRACT

An endcap header assembly includes a primary frame and an auxiliary frame. The primary frame includes a back wall, a top wall extending forwardly from the back wall, and a bottom wall extending forwardly from the back wall opposite the top wall to define a sign holder track in front of the back wall and at least partially open opposite the back wall. The auxiliary frame includes a primary panel, a top panel, and a bottom panel extending across a bottom of the primary panel. The top and bottom panels collectively define a first auxiliary sign reception track on a first side of the primary panel and a second auxiliary sign reception track on a second side of the primary panel. The auxiliary frame is configured to be slidably and selectively received within the sign holder reception track in a first configuration and a second configuration.

18 Claims, 15 Drawing Sheets

(56) References Cited

U.S. PATENT DOCUMENTS

| | | | | | |
|---|---|---|---|---|---|
| 4,722,147 | A | | 2/1988 | Gieske et al. | |
| 5,052,137 | A | * | 10/1991 | Edwards | G09F 7/08 40/607.11 |
| 5,465,516 | A | | 11/1995 | Stabile | |
| 5,511,332 | A | * | 4/1996 | Sturkie | G09F 7/10 248/223.41 |
| 5,528,845 | A | * | 6/1996 | Grate | G09F 13/0413 40/576 |
| 5,930,926 | A | * | 8/1999 | Kaplan | G09F 7/10 40/124.4 |
| 6,076,295 | A | | 6/2000 | Garfinkle | |
| 6,092,320 | A | * | 7/2000 | Bringuet | G09F 7/10 40/618 |
| 6,671,988 | B2 | * | 1/2004 | Cyrluk | G09F 7/18 40/617 |
| 6,802,145 | B2 | | 10/2004 | Sparkowski | |
| 7,143,534 | B2 | | 12/2006 | Kaminski | |
| 8,650,785 | B1 | | 2/2014 | Logan et al. | |
| 8,782,936 | B2 | | 7/2014 | Logan et al. | |
| 8,959,813 | B2 | | 2/2015 | Denby et al. | |
| D730,663 | S | | 6/2015 | Logan et al. | |
| 2002/0026737 | A1 | * | 3/2002 | Tramont | G09F 7/08 40/606.19 |
| 2012/0066948 | A1 | | 3/2012 | Martin et al. | |
| 2012/0144708 | A1 | | 6/2012 | Schwartz | |
| 2016/0351088 | A1 | | 12/2016 | Logan et al. | |

OTHER PUBLICATIONS

"Universal Gondola Header", printed from www.ffr.com/universal-gondola-header, publicly available at least as early as Feb. 16, 2015, per http://web.archive.org (4 pages).

* cited by examiner

ENDCAP HEADER ASSEMBLY AND ASSOCIATED METHODS

BACKGROUND OF THE INVENTION

Signs are commonly used in retail settings to present information to customers about a promotion and/or a product for purchase. For example, overhead signs are hung over a grouping of display structures including related products and are used to indicate a general location of the products. Upright signs can be positioned adjacent display structures or in aisles between display structures to direct the customer to a product location or to inform the customer of sales or promotions. In other instances, signs are attached directly to the display structures, such as on shelving, to provide identifying and/or price information to the customer.

SUMMARY

One aspect of the present invention relates to an endcap header assembly configured to be coupled to a retail display structure includes a primary frame and an auxiliary frame. The primary frame includes a back wall, a top wall extending forwardly from the back wall, and a bottom wall extending forwardly from the back wall opposite the top wall to define a sign holder reception track in front of the back wall and at least partially open opposite the back wall. The auxiliary frame includes a primary panel, a top panel extending across a top of the primary panel, and a bottom panel extending across a bottom of the primary panel. The top panel and the bottom panel collectively define a first auxiliary sign reception track on a first side of the primary panel and a second auxiliary sign reception track on a second side of the primary panel. The auxiliary frame is configured to be slidably and selectively received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track. Other assemblies, methods, etc. are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" and "substantially" each applies to all numeric values or descriptive terms, respectively, and generally indicate a range of numbers or characteristics that one of skill in the art would consider equivalent to the recited values or terms, that is, having the same function or results.

A new endcap header assembly is provided for displaying signage near the top of a retail display system endcap configured to draw the attention of consumers, to inform consumers about the price or other features of items offered for retail sale, to identify the items offered for retail sale near the endcap header assembly, and/or to direct a consumer toward the location of items offered for retail sale. The endcap header assembly includes a primary header frame and an auxiliary header frame configured to selectively work together in two or more configurations to display different signs and/or types of signs to consumers. In one example, the endcap header assembly additionally is configured to store signs within the primary header frame in a hidden position during periods of nonuse.

In one embodiment, the auxiliary header frame is configured to hold two different signs, for example, two different signs each being a different sign type, one on a first side and one on a second side thereof. The auxiliary header frame slides into and out of the primary header in either one of a first configuration, where the one of the two different signs on the first side of the auxiliary header frame faces an open window of the primary header frame, and a second configuration, where the one of the two different signs on the first side of the auxiliary header frame faces away from the open window of the primary header frame. The primary header frame covers the top and bottom edges of both the two different signs and the auxiliary header frame from view by consumers providing an aesthetically pleasing display. In one embodiment, end caps are applied to opposing ends of primary header frame to cover opposing ends of the auxiliary header frame and/or, in one example, provide navigational or other information to the consumer. In one example, the endcap header assembly is secured to a product display structure via hooks received in elongated slots vertically arrayed on either side of the product display structure.

Figure 1:
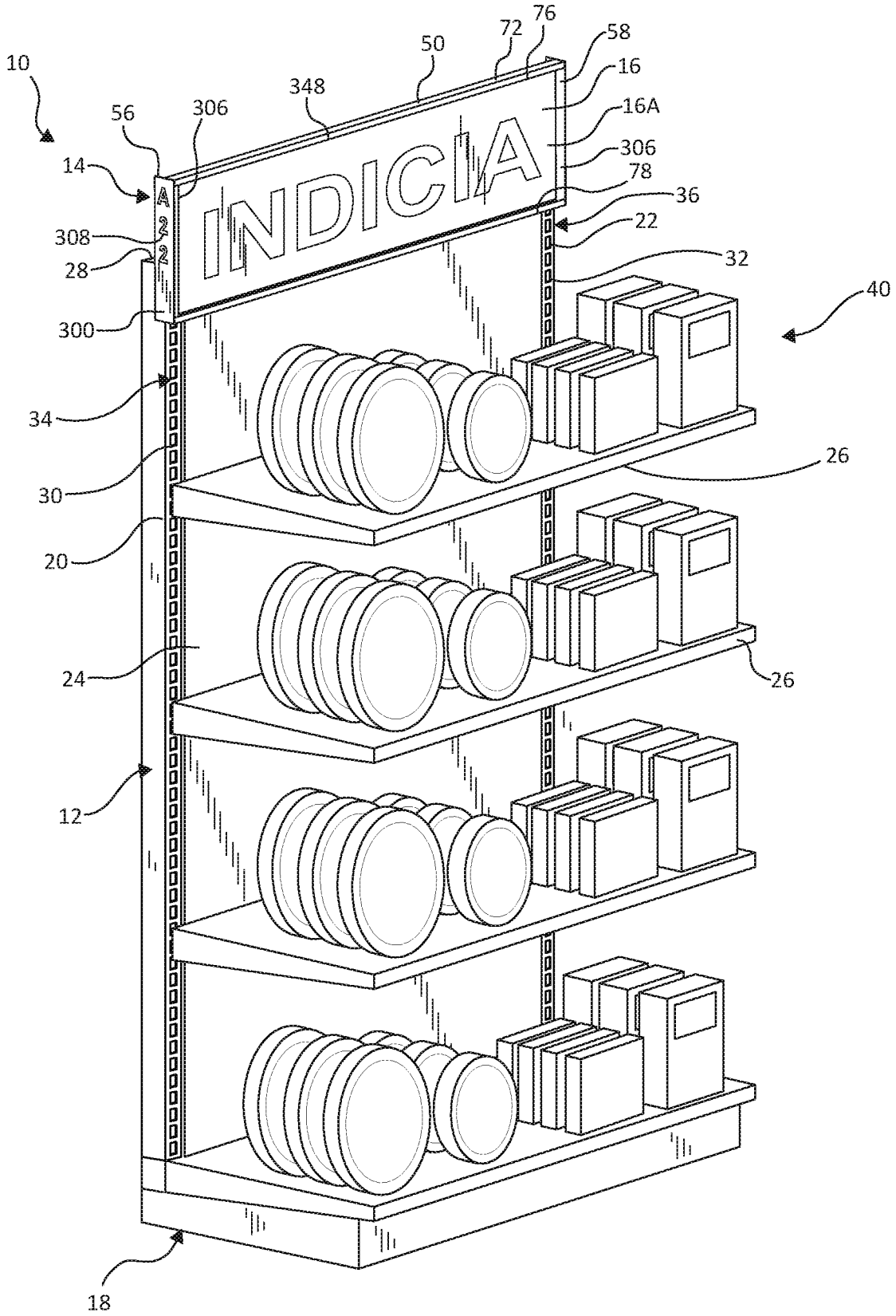
FIG. 1 is a front, perspective view illustration of a display system including an endcap header assembly coupled to a display structure having product displayed thereon, according to one embodiment of the present invention.
Figure 2:
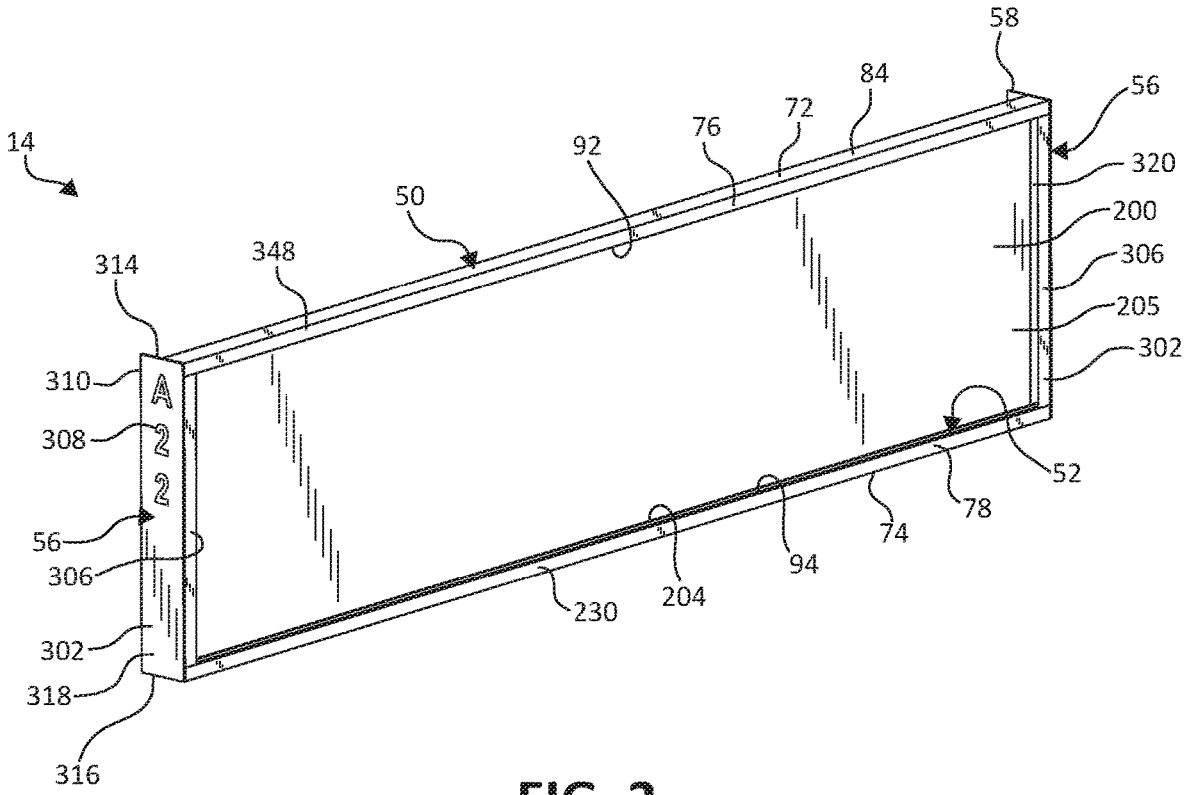
FIG. 2 is a front, perspective view illustration of the endcap header assembly of FIG. 1, according to one embodiment of the present invention.
Figure 3:
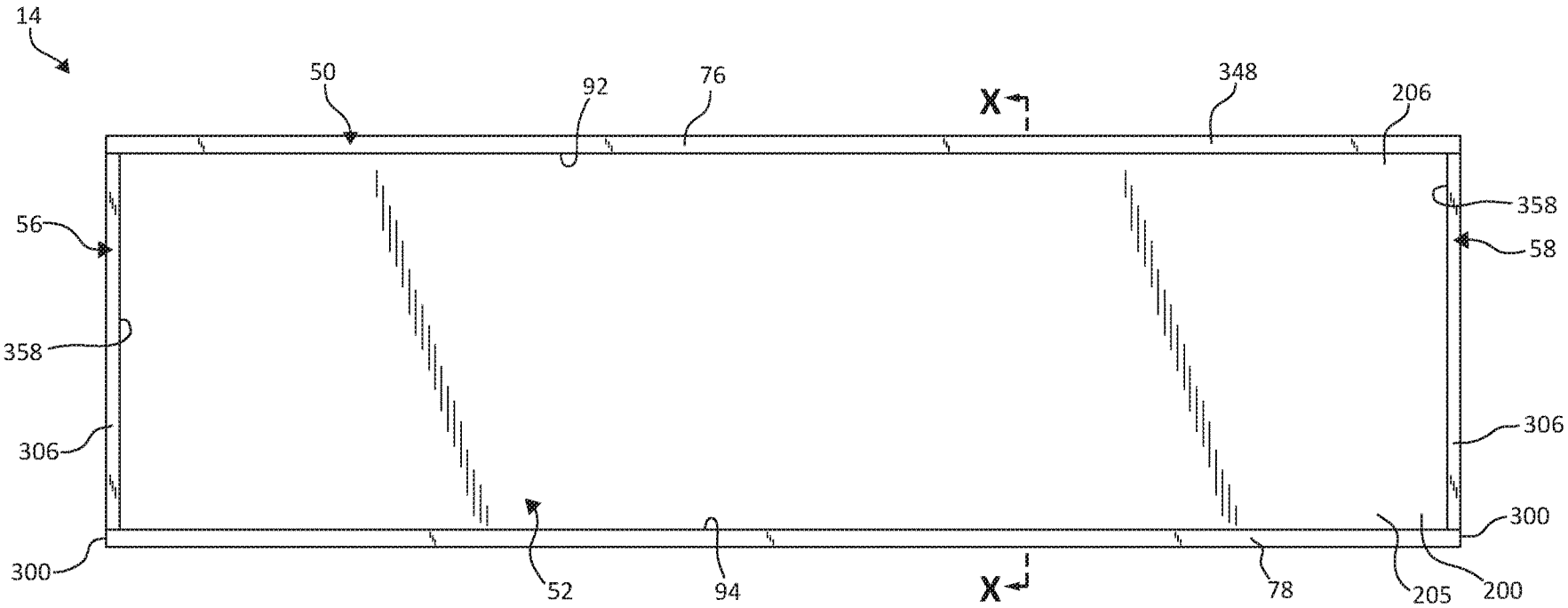
FIG. 3 is front view illustration of the endcap header assembly of FIG. 1, according to one embodiment of the present invention.
Figure 4:
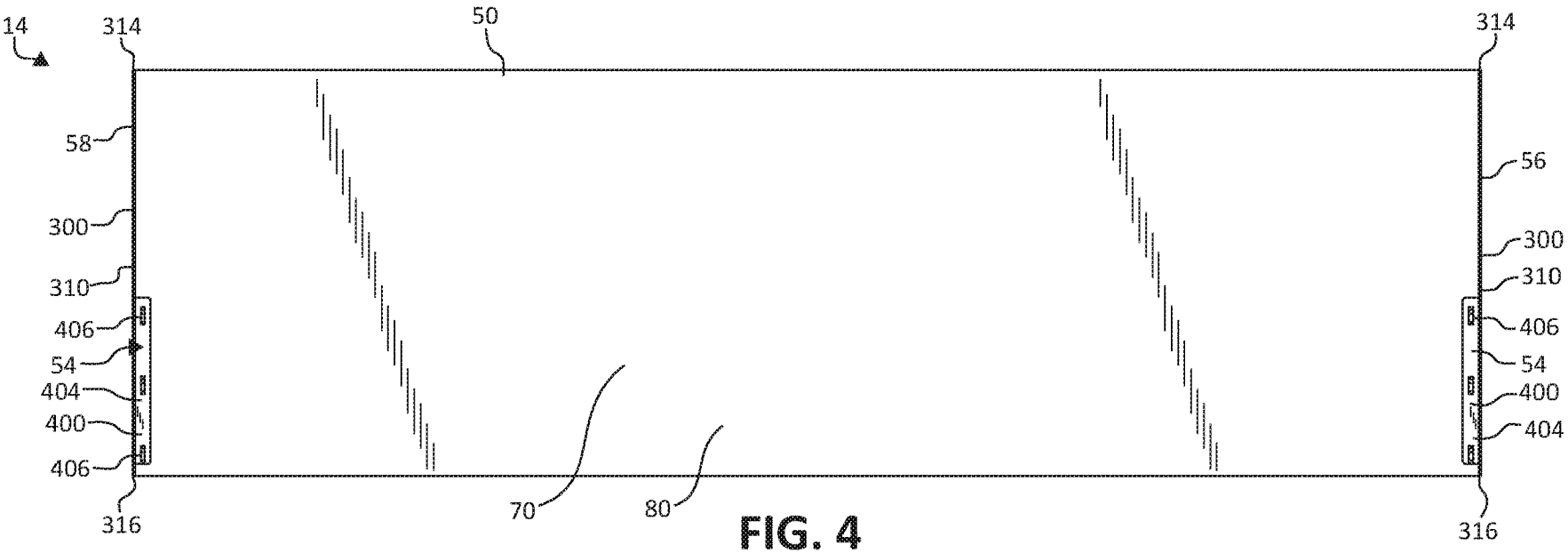
FIG. 4 is rear view illustration of the endcap header assembly of FIG. 1, according to one embodiment of the present invention.
Figure 5:
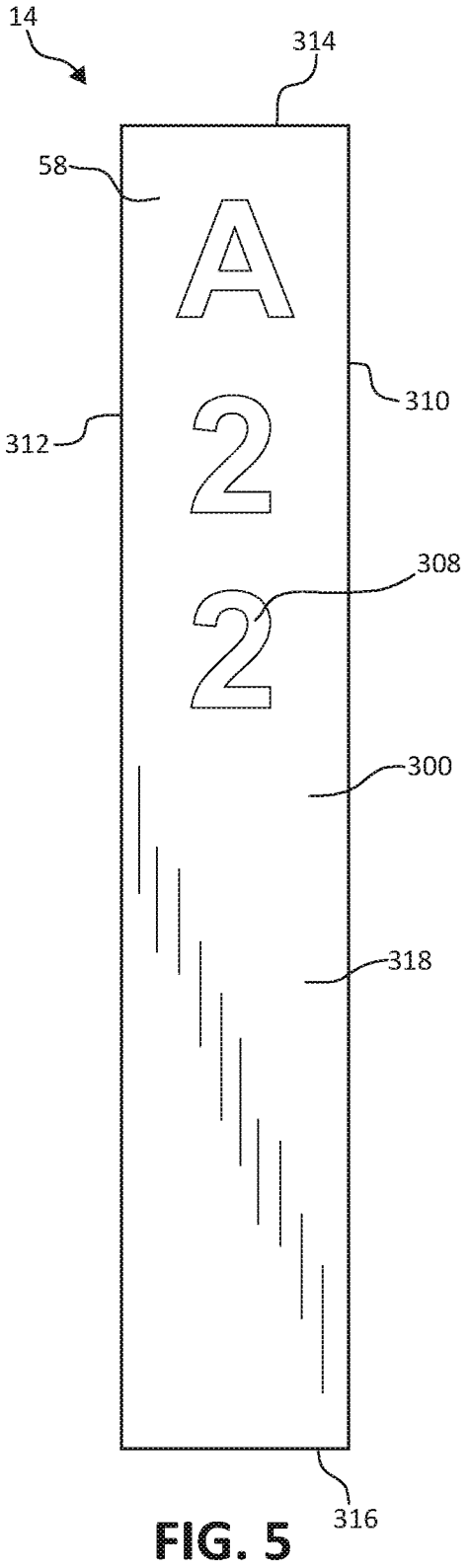
FIG. 5 is a right side view illustration of the endcap header assembly of FIG. 1, according to one embodiment of the present invention.
Figure 6:
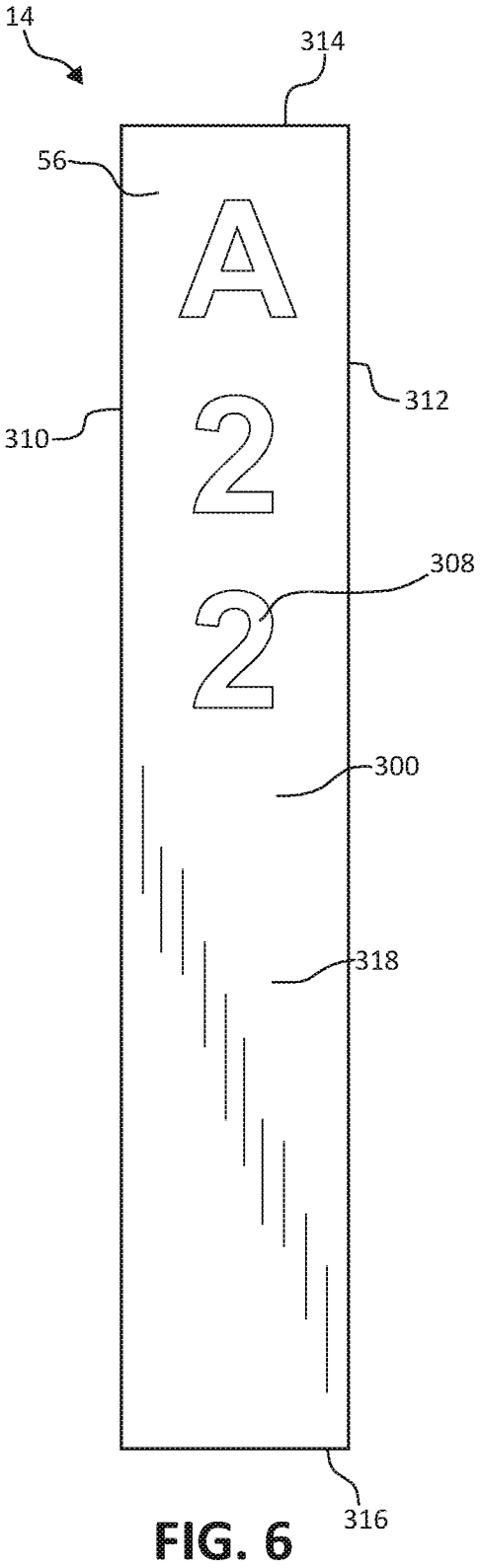
FIG. 6 is a left side view illustration of the endcap header assembly of FIG. 1, according to one embodiment of the present invention.
Figure 7:
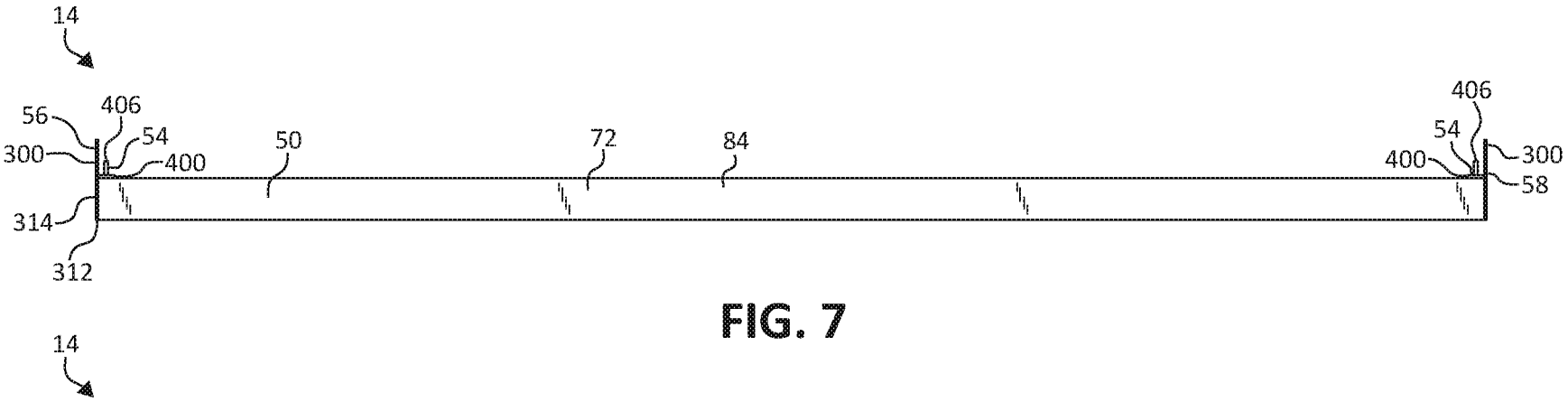
FIG. 7 is a top view illustration of the endcap header assembly of FIG. 1, according to one embodiment of the present invention.
Figure 8:
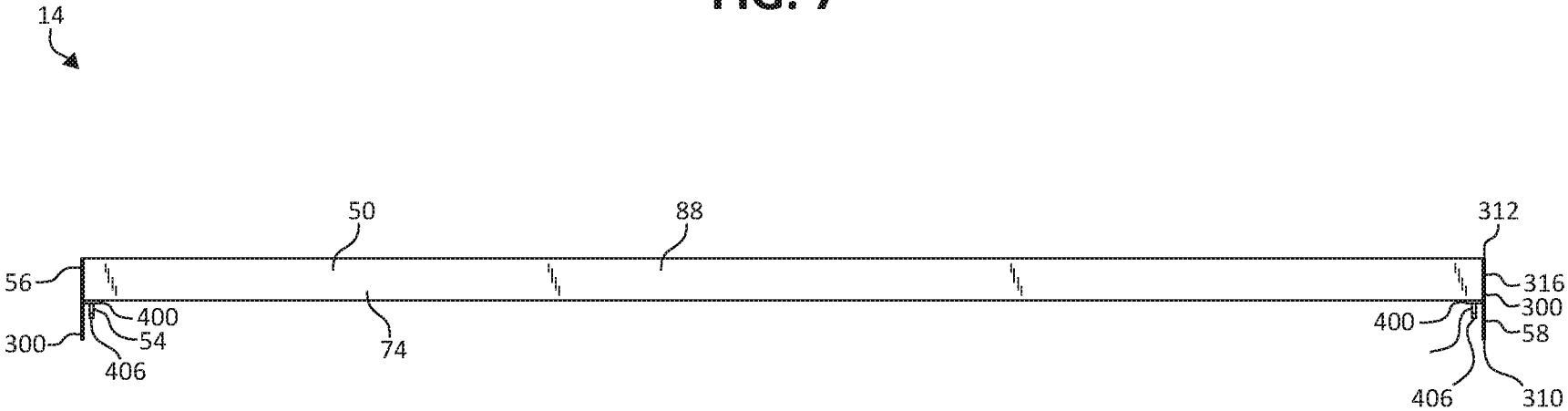
FIG. 8 is a front perspective view illustration of the endcap header assembly of FIG. 1, according to one embodiment of the present invention.

Turning to the figures, FIG. 1 illustrates one example of a display system 10 including a retail display structure 12, an endcap header assembly 14, and one or more signs 16. In one embodiment, retail display structure 12 is placed at the end of an aisle (not shown) facing in a direction substantially perpendicular or otherwise offset from front edges (not shown) of the aisle shelving (not shown) as an endcap, as will be apparent to those of skill in the art reading the present application. However, other placements of retail display structure 12 are also contemplated. Endcap header assembly 14 is selectively coupled to retail display structure 12 at a desired height to be readily visible to consumers and selectively maintains the one or more signs 16 for display to the consumer and/or for storage during periods of non-use. For example, endcap header assembly 14 is positioned at the top of retail display structure 12. In one embodiment, endcap header assembly 14 is reconfigurable to allow different signs 16 maintained therein to be visible to consumers, that is, to face outwardly from endcap header assembly 14, in different configurations.

Retail display structure 12 generally includes a base 18, vertically extending supports 20 and 22, a display back panel 24, and horizontal-shelves 26. In one embodiment, base 18 is a generally rectangular, however, may take any one of a variety of suitable shapes. In one example, base 18 is partially or entirely eliminated. Vertically extending supports 20 and 22 are positioned opposite one another and extend upwardly from base 18 or from near the floor itself where base 18 is eliminated toward, and in one example, substantially to a top edge 28 of retail display structure 12. Vertically extending supports 20 and 22 include a forward surface 30 and a forward surface 32, respectively, each including an array of slots 34 and 36, respectively, for receiving fastening mechanisms to attach various components to retail display structure 12.

For example, horizontal shelves 26 are coupled to retail display structure 12 via prongs (not shown) on opposing ends thereof that are selectively inserted into corresponding ones of the array of slots 34 and 36 on vertically extending supports 20 and 22. In this way, horizontal shelves 26 are selectively coupled to vertically extending supports 20 and 22 and extend outwardly from retail display structure 12 to support various products 40, etc. being offered for retail sale and/or otherwise presented to the consumer. Use of other display accessories such as hanging rods, support pockets, etc. supported by and extending between vertically extending supports 20 and 22 or otherwise incorporated into retail display structure 12 in addition to or as an alternative to horizontal shelves 26 are also contemplated, as is the elimination of horizontal shelves 26.

Additionally, referring to FIGS. 2-9, endcap header assembly 14 includes a primary frame 50, an auxiliary frame 52, coupling means 54, and first and second end covers 56 and 58, respectively. Primary frame 50 is configured to slidably receive auxiliary frame 52 therein in each of at least two configurations to change the face of auxiliary frame 52 facing outwardly from primary frame 50. In one example, one or more signs 16 includes one or more of a sign 16A supported by primary frame 50 and one or more of signs 16B and 16C (see FIGS. 12-17) supported by auxiliary frame 52. First and second end covers 56 and 58 selectively cap opposing ends of primary frame 50 in a manner substantially concealing edges of primary frame 50 and auxiliary frame 52 from view, thereby making endcap header assembly 14 more aesthetically pleasing, generally preventing inadvertent removal of sign 16A from primary frame 50 and/or removal of either of signs 16B and 16C from auxiliary frame 52.

Endcap header assembly 14 is selectively secured to retail display structure 12 at a desired height via vertically extending supports 20 and 22. In one example, endcap header assembly 14 is secured to retail display structure 12 near, and in one instance, to extend over a top of top edge 28 of retail display structure 12. In this manner, endcap header assembly 14 is able to hold one or more signs 16 at a top height easily identifiable by consumer and/or configured to draw a consumer's attention to goods (FIG. 1) on retail display structure 12. Endcap header assembly 14 includes coupling means 54 secured thereto, for example, to primary frame 50, for selectively coupling with retail display structure 12. In one embodiment, coupling means 54 are configured to selectively interact with vertically extending supports 20 and 22 via slots 34 and 36, as will be further described below.

Figure 9:
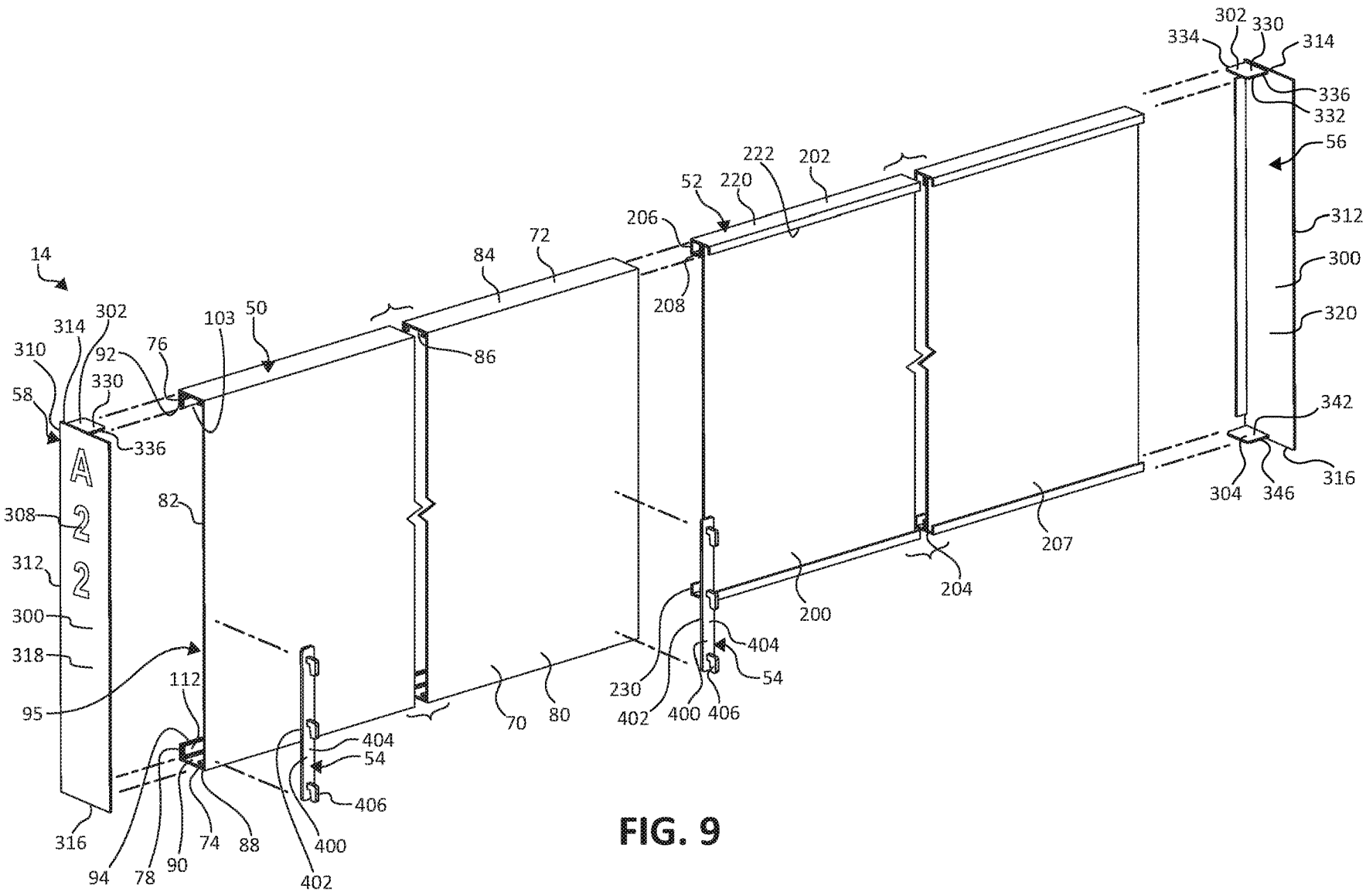
FIG. 9 is an exploded view illustration of the end frame assembly of FIG. 2, according to one embodiment of the present invention.
Figure 10:
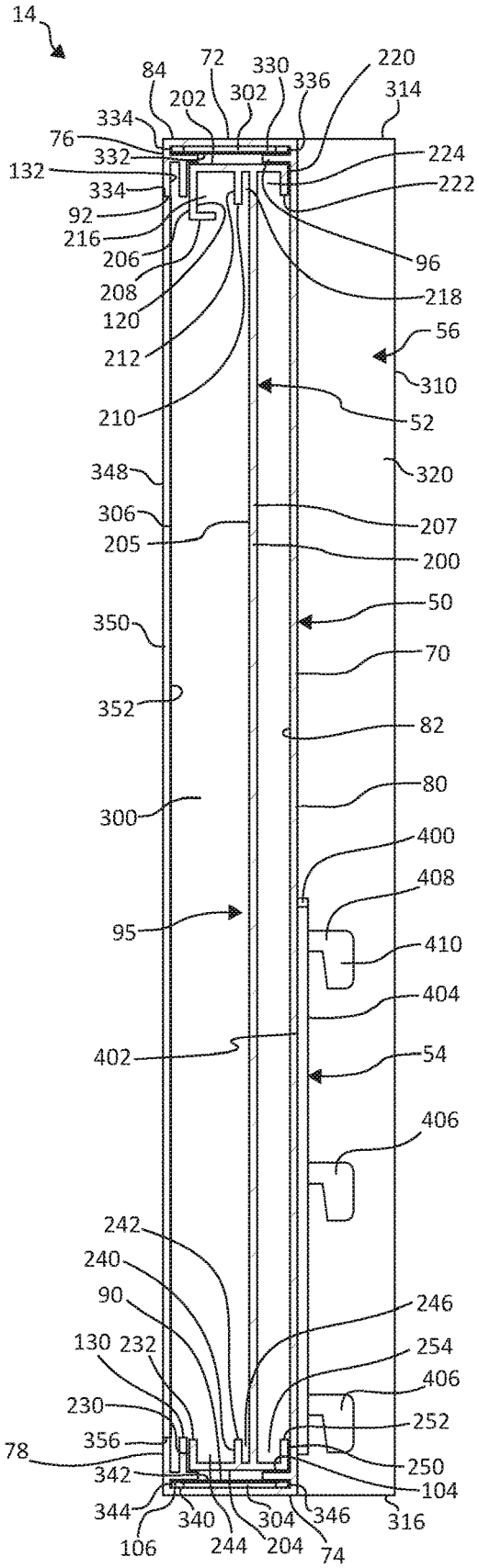
FIG. 10 is cross-sectional illustration of the endcap header assembly without signs taken along the line X-X of FIG. 3, according to one embodiment of the present invention.
Figure 11:
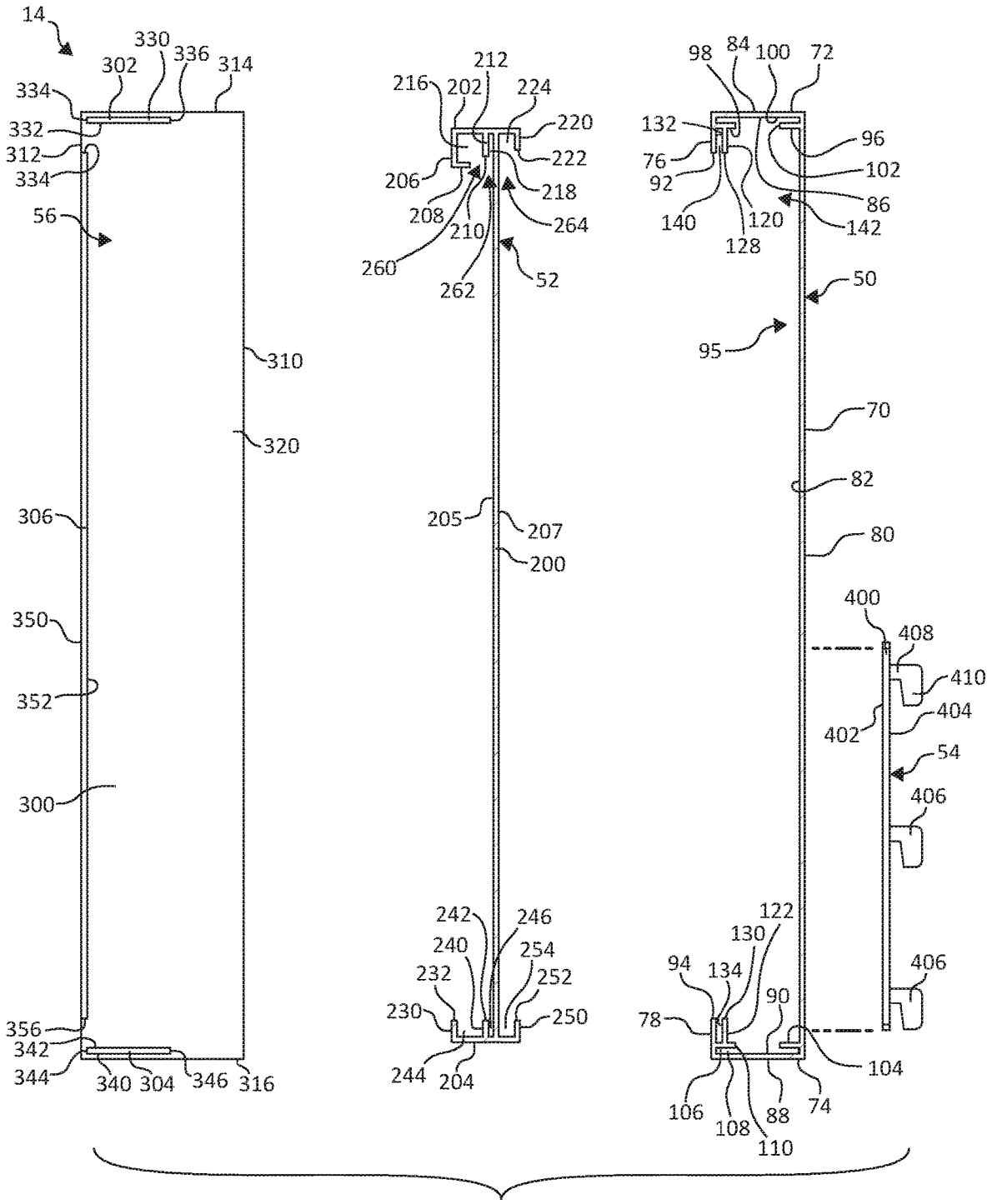
FIG. 11 is an exploded view illustration of the cross-sectional view of the portion of the endcap header assembly in FIG. 10, according to one embodiment of the present invention.

Referring to the end view of FIG. 11 and views of FIGS. 9 and 10, primary frame 50, in one embodiment, includes a back wall 70, a top wall 72, a bottom wall 74, a top front flange 76, and a bottom front flange 78. Back wall 70 is substantially planar, in one example, defining an exterior surface 80 and an interior surface 82 facing in an opposite direction as exterior surface 80. In one example, exterior surface 80 faces away from a remainder of primary frame 50. Top wall 72 extends forwardly from a top edge of back wall 70, for example, with a substantially perpendicular extension from back wall 70. Top wall 72 includes a top surface 84, which is substantially planar, and an interior surface 86 facing in an opposite direction as compared to top surface 84 toward bottom wall 74. In one example, bottom wall 74 defines a bottom surface 88, facing away from top wall 72, and interior surface 90 facing in an opposite direction than bottom surface 88, that is, facing toward top wall 72.

Top front flange 76 extends from top wall 72 opposite back wall 70 downwardly toward bottom wall 74, in one embodiment, with a height substantially smaller than a height of back wall 70, to a free or inside edge 92. Similarly, bottom front flange 78 extends from an edge of bottom wall 74 opposite back wall 70, upwardly toward top front flange 76 to a free or inside edge 94. In one example, top front flange 76 and bottom front flange 78 are substantially coplanar, each spaced a substantially identical distance way from interior surface 82 of back wall 70. In one example, primary frame 50 defines an open cavity 95 in front of back wall 70, behind top front flange 76 and bottom front flange 78, and between top wall 72 and bottom wall 74.

In one embodiment, a top and rear horizontal flange 96, extends forwardly from back wall 70 just below top wall 72, and a top and front horizontal flange 98 extending rearwardly from top front flange 76 just below top wall 72 to define a top track or slot 100 between back wall 70 and top front flange 76 and just below top wall 72. Top and rear horizontal flange 96 and top and front horizontal flange 98 are substantially coplanar, in one embodiment. In one example, top slot 100 includes an opening 102 thereto between top and front horizontal flange 98 and top front flange 76 connecting top slot 100 to open cavity 95, while in another embodiment, top and rear horizontal flange 96 and top and front horizontal flange 98 border each other, or are substantially a single flange, such that opening 102 is eliminated.

In one embodiment, a bottom and rear horizontal flange 104, extends forwardly from back wall 70 just above bottom wall 74, and a bottom and front horizontal flange 106 extending rearwardly from bottom front flange 78 near bottom wall 74 to define a bottom track or slot 108 between back wall 70 and top front flange 76 and near bottom wall 74. Bottom and rear horizontal flange 104 and bottom and front horizontal flange 106 are substantially coplanar, in one embodiment. In one example, bottom slot 108 includes an opening 110 thereto between bottom and front horizontal flange 106 and bottom and rear horizontal flange 104 connecting bottom slot 108 to open cavity 95, while in another embodiment, bottom and rear horizontal flange 104 and bottom and front horizontal flange 106 border each other, or are substantially a single flange, such that opening 110 is eliminated. In one example, each of opening 102 and opening 110 are substantially identical in size and shape, and each of opening 102 and opening 110 is sized to selectively receive a portion of each of first and second end covers 56 and 58 to facilitate coupling of primary frame 50 therewith.

In one embodiment, primary frame 50 additionally includes an interior downwardly extending flange 120 and an interior upwardly extending flange 122. Interior downwardly extending flange 120 extends from a bottom of top and front horizontal flange 98 downwardly toward bottom wall 74 to a free, bottom edge 128. In one example, interior downwardly extending flange 120 is rearwardly offset from top front flange 76 to define a top vertical slot 132 between interior downwardly extending flange 120 and top front flange 76 open at a bottom side thereof.

Interior upwardly extending flange 122 extends from a top of bottom and front horizontal flange 106 upwardly toward top wall 72 to a free, top edge 130. In one example, interior downwardly extending flange 122 is rearwardly offset from bottom front flange 78 to define a bottom vertical slot 134 between interior upwardly extending flange 122 and top front flange 76 open at a top side thereof. In one embodiment, interior downwardly extending flange 120 and an interior upwardly extending flange 122 are substantially coplanar and free, bottom edge 128 is aligned with free, top edge 130. In one example, a track for receiving a sign is formed between and including each of top vertical slot 132 and bottom vertical slot 134.

Auxiliary frame 52, in one embodiment, includes a primary panel 200, a top panel 202, a bottom panel 204, a top front flange 76, and a bottom front flange 78. Back wall 70 is substantially planar, in one example, defining an exterior surface 80 and an interior surface 82 facing in an opposite direction as exterior surface 80. In one example, exterior surface 80 faces away from a remainder of primary frame 50. Top wall 72 extends forwardly from a top edge of back wall 70, for example, with a substantially perpendicular extension from back wall 70. Top wall 72 includes a top surface 84, which is substantially planar, and an interior surface 86 facing in an opposite direction as compared to top surface 84 toward bottom wall 74. In one example, bottom wall 74 defines a bottom surface 88, facing away from top wall 72, and interior surface 90 facing in an opposite direction than bottom surface 88, that is, facing toward top wall 72.

Top front flange 76 extends from top wall 72 opposite back wall 70 downwardly toward bottom wall 74, in one embodiment, with a height substantially small than a height of back wall 70, to a free or inside edge 92. Similarly, bottom front flange 78 extends from an edge of bottom wall 74 opposite back wall 70, upwardly toward top front flange 76 to a free or inside edge 94. In one example, top front flange 76 and bottom front flange 78 are substantially coplanar each spaced a substantially identical distance way from interior surface 82 of back wall 70. In one example, primary frame 50 defines an open cavity 95 in front of back wall 70, behind top front flange 76 and bottom front flange 78, and between top wall 72 and bottom wall 74.

In one embodiment, a top and rear horizontal flange 96, extends forwardly from back wall 70 just below top wall 72, and a top and front horizontal flange 98 extending rearwardly from top front flange 76 just below top wall 72 to define a top track or slot 100 between back wall 70 and top front flange 76 and just below top wall 72. Top and rear horizontal flange 96 and top and front horizontal flange 98 are substantially coplanar, in one embodiment. In one example, top slot 100 includes an opening 102 thereto between top and front horizontal flange 98 and top front flange 76 connecting top slot 100 to open cavity 95, while in another embodiment, top and rear horizontal flange 96 and top and front horizontal flange 98 border each other, or are substantially a single flange, such that opening 102 is eliminated.

In one embodiment, a bottom and rear horizontal flange 104, extends forwardly from back wall 70 just above bottom wall 74, and a bottom and front horizontal flange 106 extending rearwardly from bottom front flange 78 just above bottom wall 74 to define a bottom track or slot 108 between back wall 70 and top front flange 76 and just above bottom wall 74. Bottom and rear horizontal flange 104 and bottom and front horizontal flange 106 are substantially coplanar, in one embodiment. In one example, bottom slot 108 includes an opening 110 thereto between bottom and front horizontal flange 106 and bottom and rear horizontal flange 104 connecting bottom slot 108 to open cavity 95, while in another embodiment, bottom and rear horizontal flange 104 and bottom and front horizontal flange 106 border each other, or are substantially a single flange, such that opening 110 is eliminated. In one example, each of opening 102 and opening 110 are substantially identical in size and shape, and each of opening 102 and opening 110 is sized to selectively receive a portion of each of first and second end covers 56 and 58 to facilitate coupling of primary frame 50 therewith.

In one embodiment, primary frame 50 additionally includes an interior downwardly extending flange 120 and an interior upwardly extending flange 122. Interior downwardly extending flange 120 extends from a bottom of top and front horizontal flange 98 downwardly toward bottom wall 74 to a free, bottom edge 128. In one example, interior downwardly extending flange 120 is rearwardly offset from top front flange 76 to define a top vertical slot 132 between interior downwardly extending flange 120 and top front flange 76 open at a bottom side thereof.

Interior upwardly extending flange 122 extends from a top of bottom and front horizontal flange 106 upwardly toward top wall 72 to a free, top edge 130. In one example, interior downwardly extending flange 122 is rearwardly offset from bottom front flange 78 to define a bottom vertical slot 134 between interior upwardly extending flange 122 and top front flange 76 open at a top side thereof. In one embodiment, interior downwardly extending flange 120 and an interior upwardly extending flange 122 are substantially coplanar and free, bottom edge 128 is aligned with free, top edge 130. In one example, as shown in FIG. 11, a sign reception track 140 for receiving a sign is formed between and includes each of top vertical slot 132 and bottom vertical slot 134 and/or a sign holder track 142 for receiving auxiliary frame 52 is formed between a space between interior downwardly extending flange 120 and back wall 70 and a space between interior upwardly extending flange 122 and back wall 70.

Auxiliary frame 52 is sized and shaped to be slidably received in sign holder track 142. In one embodiment, auxiliary frame 52 includes a primary panel 200, a top panel 202, a bottom panel 204, a first depending panel 206, and a first rising panel 230. Primary panel 200 is substantially planar, in one example, defining a first surface 205 and a second surface 207 facing in an opposite direction as first surface 205. Top panel 202 extends across a top edge of primary panel 200, for example, with a substantially perpendicular extension from primary panel 200. In one example, top panel 202 extends across and in both directions from primary panel 200. Similarly, in one embodiment, bottom panel 204 extends across a bottom edge of primary panel 200, for example, with a substantially perpendicular extension from primary panel 200. In one example, bottom panel 204 extends across and in both directions from primary panel 200. Top panel 202 and bottom panel 204 are sub substantially parallel with one another in one embodiment.

In one embodiment, first depending panel 206 depends downwardly from an edge, for example, a frontmost edge in the orientation of FIG. 11, of top panel 202 partially, toward bottom panel 204 with a substantially perpendicular orientation relative to top panel 202. A rearwardly extending flange 208 extends from a bottom of first depending panel 206 toward, but not to, primary panel 200 to a free, back edge. In one example, auxiliary frame 52 forms a front channel 216 between top panel 202 and rearwardly extending flange 208 and between first depending panel 206 and top panel 202. Front channel 216 is open at a bottom portion thereof between rearwardly extending flange 208 and primary panel 200.

In one example, auxiliary frame 52 additionally includes an interior downwardly extending flange 212 extending downwardly from, for instance, substantially perpendicularly from, a bottom surface of top panel 202 to a free, bottom edge 214. Interior downwardly extending flange 212 is positioned in front of primary panel 200 and behind free, back edge 210. In one example, interior downwardly extending flange 212 does not extend as far away from top panel 292 as first depending panel 206. Auxiliary frame 52 defines a top interior channel 218 between primary panel 200 and interior downwardly extending flange 212 in one embodiment.

In one embodiment, auxiliary frame 53 additionally or alternatively defines a second depending panel 220 extending downwardly from an edge of top panel 202 opposite first depending panel 206 partially, toward bottom panel 204 with a substantially perpendicular orientation relative to top panel 202 and terminating at a free, bottom edge 222. In one example, a back channel 224 is defined between primary panel 200 and second depending panel 220 open to a bottom thereof.

In one embodiment, first rising panel 230 extends upwardly from an edge, for example, a frontmost edge in the orientation of FIG. 11, of bottom panel 204 partially, toward top panel 202 with a substantially perpendicular orientation relative to bottom panel 204 terminating at a top edge 232. In one example, auxiliary frame 52 forms a front channel 244 between front rising panel 230 and primary panel 200 just above bottom panel 204. Front channel 216 is open at a top portion thereof and laterally aligns with front channel 216 to collectively define a sign reception track 260 therebetween. In one embodiment, first depending panel 206 and first rising panel 230 are positioned and orientated to be substantially coplanar with one another.

In one example, auxiliary frame 52 additionally includes an interior upwardly extending flange 240 extending upwardly from, for instance, substantially perpendicularly from, a top surface of bottom panel 204 to a free, top edge 242. Interior upwardly extending flange 240 is positioned in front of primary panel 200 and behind first rising panel 230 in the orientation of FIG. 11. In one example, interior upwardly extending flange 240 extends a distance away from bottom panel 204 a substantially equal to a distance first rising panel 230 extends upwardly from bottom panel 204. Auxiliary frame 52 defines a bottom interior channel 246 between primary panel 200 and interior upwardly extending flange 240 in one embodiment. In one embodiment, interior upwardly extending flange 240 is positioned and orientated to be substantially coplanar with interior downwardly extending flange 212. A sign reception track 262 is defined to include and extend between top interior channel 218 and bottom interior channel 246, in one example.

In one embodiment, auxiliary frame 53 additionally or alternatively defines a second rising panel 250 extending upwardly from an edge of bottom panel 204 opposite first rising panel 230 partially, toward top panel 202 with a substantially perpendicular orientation relative to bottom panel 204 and terminating at a free, top edge 252. In one example, a back channel 254 is defined between primary panel 200 and second rising panel 250 open to a top thereof. In one embodiment, second rising panel 250 is positioned and oriented to be substantially coplanar with second depending panel 220 in a manner forming a sign reception track 264 to include and extend between back channel 224 and back channel 254. In one embodiment, each of sign reception tracks 260, 262, and 264 longitudinally extend between opposing ends of a primary panel 200 substantially parallel with one another.

First end cover 56 and second end cover 58 are substantially mirror images of each other. As such, while only first end cover 56 is described in detail below, it should be understood that second end cover 58 is formed substantially identical to other than being a mirror image thereof, hence the repeated reference numeral shown for each of first end cover 56 and second end cover 58 in the figures. Referring primarily to FIGS. 9 and 11, in one example, first end cover 56 includes an end panel 300, a top tab 302, a bottom tab 304, and a side front flange 306. End panel 300 is substantially planar, defining an exterior surface 318 and an opposite interior surface 320, and is sized with a height at least substantially equal to a height of primary frame 50 and a width equal and, in one example, greater than a width of primary frame 50. In one embodiment, end panel 300 substantially entirely covers an end of primary frame 50. In one example, exterior surface 318 of end panel additionally includes indicia 308, such as marketing indicia, identifying indicia, navigational indicia, etc. End panel 300 defines a rear edge 310, a front edge 312 opposite rear edge 310, a top edge 314 extending between front edge 312 and rear edge 310, and a bottom edge 316 opposite top edge 314 and extending between front edge 312 and rear edge 310.

Each of top tab 302, bottom tab 304, and side front flange 306 extend from interior surface 320 away from exterior surface 318 terminating along a corresponding free edge. Top tab 302 is positioned just below top edge 314 of end panel 300 and just rearwardly or front edge 312, in one embodiment. Top tab 302 is substantially planar defining a top surface 330, a bottom surface 332 opposite top surface 330, a front edge 334, and a rear edge 336 opposite front edge 334. A width of top tab 302 measured between front edge 334 and rear edge 336 is substantially equal to a width of top slot 100 of primary frame 50 and/or a thickness of top tab 302 measured between top surface 330 and bottom surface 332 is substantially equal to a height of top slot 100 of primary frame 50, in one embodiment.

Bottom tab 304 is formed to be substantially symmetrical with top tab 302 about a horizontal center line of end first end cover 56, according to one embodiment of the present invention. In one example, bottom tab 304 is positioned just above bottom edge 316 of end panel 300 and just rearwardly or front edge 312, in one embodiment. Bottom tab 304 is substantially planar defining a top surface 342, a bottom surface 340 opposite top surface 342, a front edge 344, and a rear edge 346 opposite front edge 344. A width of bottom tab 304 measured between front edge 344 and rear edge 346 is substantially equal to a width of bottom slot 108 of primary frame 50 and/or a thickness of bottom tab 304 measured between 108 of primary frame 50, in one embodiment.

Side front flange 306, in one embodiment, extends from interior surface 320 adjacent front edge 312 along a substantial entirety thereof, but stopping short of extending beyond a vertical location of top tab 302 a bottom tab 304. Side front flange 306 is substantially planar defining a front surface 2350 and a rear surface 352 opposite front surface 350. In one example, side front flange 306 is substantially rectangular defining a top edge 354, a bottom edge 356 opposite top edge 354, and an inside edge 358 extending between top edge 354 and bottom edge 356 opposite end panel 300. In one example, a distance side front flange 306 extends from end panel 300 is substantially equal to a distance bottom front flange 78 extends from bottom wall 74 and a distance top front flange 76 extends from top wall 72 such that side front flanges 306, bottom front flange 78, and top front flange 76 collectively form a front frame 348 upon assembly as can be seen, for example, with additional reference to FIG. 1.

Continuing to refer to FIGS. 9-11, coupling means 54 are any suitable means for permanently or selectively coupling endcap header assembly 14 to display structure 11 (FIG. 1). One example, coupling means 54 includes hooked assemblies for interfacing with the array of slots 34 or 36 in one of vertically extending supports 20 and 22 of display structure 11 as shown in FIG. 1. More specifically, in one example, coupling means 54 includes a backer panel 400 and hooks or prongs 406 extending rearwardly therefrom. In one embodiment, backer panel 400 is substantially planar defining a front facing surface 402 and a rear facing surface 404 opposite front facing surface 402. Each of prongs 406, for example, at least two prongs 406, and in one example, at least three prongs 406, extend rearwardly from rear facing surface 404. Each prong 406 includes a rearwardly extending portion 408 extending away from rear facing surface 404 of backer panel 400 and a downwardly extending portion 410 extending downwardly from an end of rearwardly extending portion 408 opposite backer panel 440. prongs are each formed from a planar material and are sized to selectively interrace with slots 34 or 36, as will be apparent to those of skill in the art upon reading the present application. In one example, at least two coupling means 54 are secured to exterior surface 80 of back wall 70 of primary frame 50 at locations configured to each align with one of vertically extending supports 20 and 22 of display structure 11 upon installation of endcap header assembly 14.

A variety of signs 16 are configured for use with endcap header assembly 14, as will be apparent to those of skill in the art, with a few examples of types of suitable signs 16 being described in detail below. In one embodiment, the plurality of signs 16 includes one or more of a first sign 16A, a second sign 16B, and a third sign 16C.

In one example, first sign 16A is a substantially planar sign defining a first primary surface 500 and a second primary surface 502 facing in an opposite direction as first primary surface 500. First sign 16A includes a top edge 504, a bottom edge 506 opposite top edge 504, a first side edge 508 extending between top edge 504 and bottom edge 506, and a second side edge 510 extending between top edge 504 and bottom edge 506 opposite first side edge 508. In one example, one or both of first primary surface 500 and second primary surface 502 include indicia 512, such as marketing indicia, informational indicia, cost indicia, navigational indicia, etc., as will be apparent to those of skill in the art upon reading this application. First sign 16A is configured to be slidably received within sign reception track 140 of primary frame 50. In one example, first sign 16A is sized to substantially fill the opening to cavity 95 either alone or collectively with other similar first signs 16A.

In one example, second sign 16B is in a tablet format, which may take on any one of a plurality of configurations as will be apparent to those of skill in the art upon reading the present application. In one embodiment, second sign 16B is formed of a plurality of flaps or panels 600 rotatably coupled together along their top edges 602 via a suitable binding 606 allowing movement of panels 600 relative to binding 606, such as a spiral binding. Each of the plurality of panels 600 extends from binding to an opposite free edge 604 and includes. In one example, a number of plurality of panels 600 are attached to binding 606 in stacks, that is, at the same location along binding 606 while other stacks and/or panels 600 are located longitudinally offset from the number of plurality of panels 600. Different indicia 608, such as numbers or symbols, or other suitable message(s), are included on each of the plurality of panels 600. In one example, binding 606 allows one of the plurality of panels 600 to be flipped or rotated thereabout to reveal a different one of pages 600 with different indicia 608 included thereon. For instance, each page 100 includes indicia 103 such as numbers to indicate pricing or letters to spell different words. Each page 100 extends along an entire length of binding 606 or is shorter than binding 606 such that stacks of the plurality of pages 100 fit edge to edge along the length of binding 606. Although binding 606 is illustrated as a spiral binding, binding 606 can take on a variety of forms and/or be a clip or other coupling mechanism for binding pages in alternate embodiments as will be apparent to those of ordinary skill after reading this application.

In one example, third sign 16C is a substantially planar sign defining a first primary surface 700 and second primary surface 702 facing in an opposite direction as first primary surface 500. Third sign 16C includes a top edge 704, a bottom edge 706 opposite top edge 704, a first side edge 708 extending between top edge 704 and bottom edge 706, and a second side edge 710 extending between top edge 704 and bottom edge 706 opposite first side edge 708. In one example, one or both of first primary surface 700 and second primary surface 702 include indicia 712, such as marketing indicia, informational indicia, cost indicia, navigational indicia, etc., as will be apparent to those of skill in the art upon reading this application. Third sign 16C is configured to be slidably received within sign reception track 264 defined between and including back channels 224 and 254 of auxiliary frame 52, as will be further described below.

Figure 12:
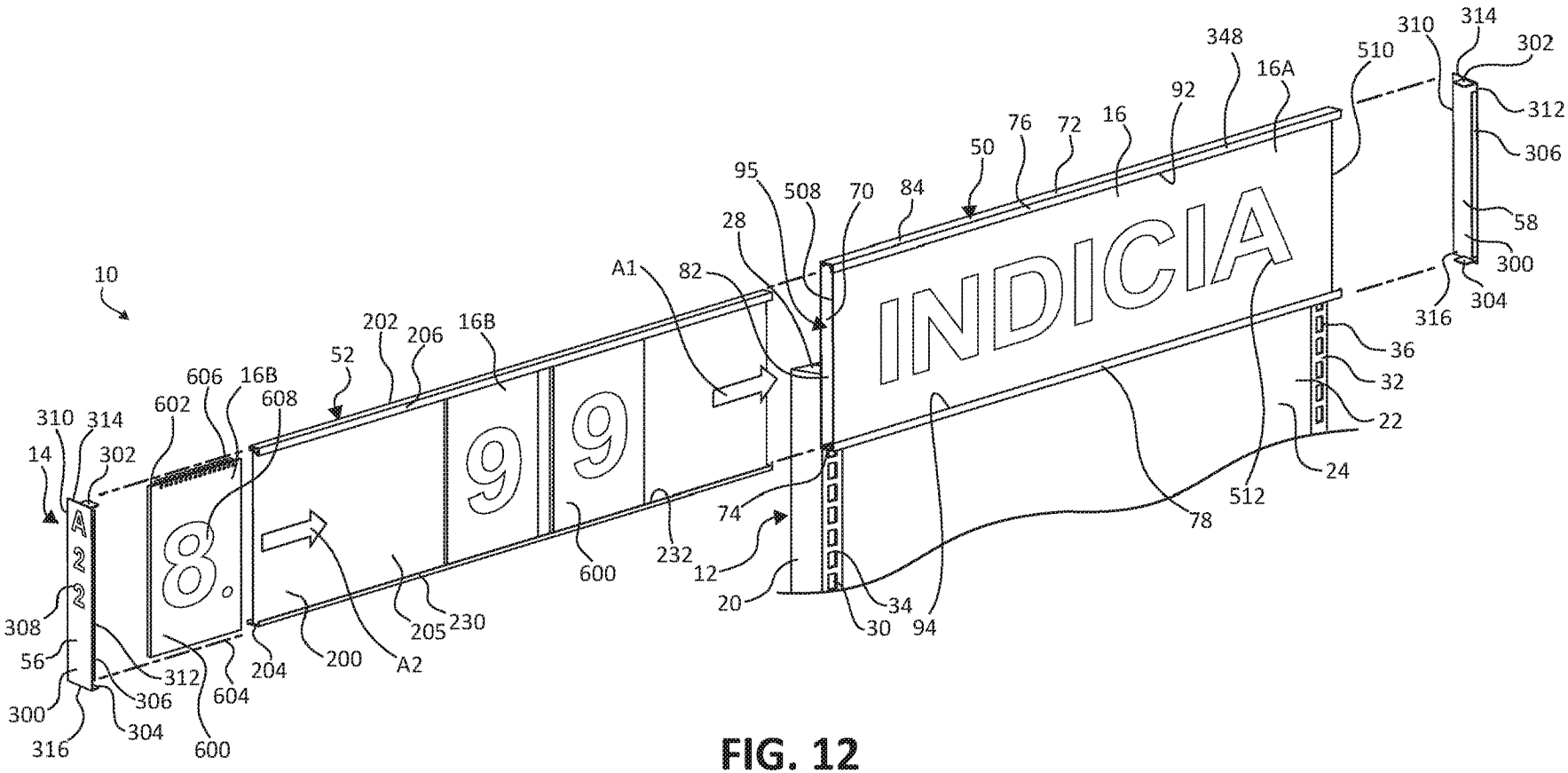
FIG. 12 is front, perspective, partially exploded view of the display system of FIG. 1 including the endcap header assembly in a first configuration, according to one embodiment of the present invention.

In one embodiment, endcap header assembly 14 is coupled to retail display structure 12 in any suitable method, such as by aligning prongs 406 of coupling means 54 on the back of primary fame 50 with corresponding elongated slots 34 and 36 on vertically extending supports 20 and 22 to hang endcap header assembly 14 from retail display structure 12 with the result being generally shown in FIG. 12. As shown in FIG. 12, first sign 16A is slid into sign reception track 140 of primary frame 50 from one of ends thereof. In one example, first sign 16A includes different indicia 512 on either side thereof, such that first sign 16A can be slid out of sign reception track 140, flipped around and slide back into sign reception track 140 exposing a different one of first primary surface 500 and second primary surface 502 and indicia 512 thereon to face opening to cavity 95 of primary frame 50.

As shown in FIG. 12, since sign reception track 140 is the forwardmost track of primary frame 50, sign 16A hide anything else in cavity 95 of primary frame 50. In one example, auxiliary frame 52 is sized and shaped to be slidably received within sign holder track 142 of primary member behind sign 16A. More specifically, in one embodiment, auxiliary frame 52 is slid into sign holder track 142 from an end of primary frame 50 as generally indicated by arrow A1 in FIG. 12 to the position shown in FIG. 13. In this manner, even when not on display, auxiliary frame 52 is stored within primary frame 50 decreasing room needed for storing sign inventory while still providing multiple display options for endcap header assembly 14.

Figure 13:
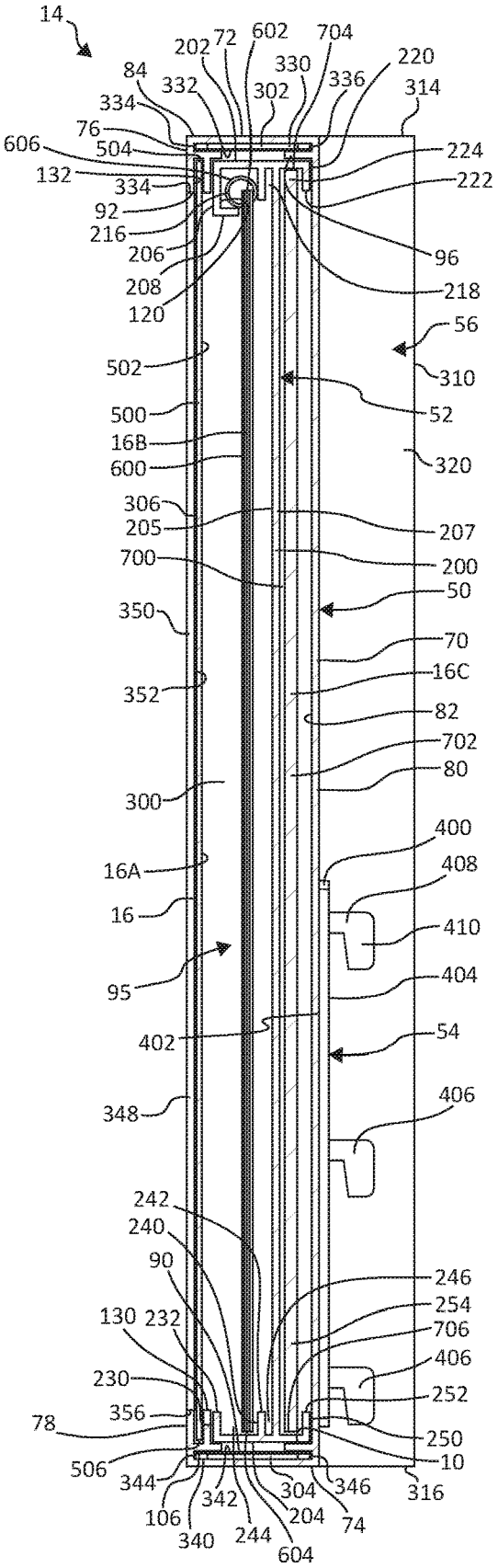
FIG. 13 is the cross-sectional illustration of the endcap header assembly of FIG. 10 with signs added thereto to form the endcap header assembly in accordance with FIG. 12, according to one embodiment of the present invention.

In addition, in one example, signs 16, such as second sign 16B and third sign 16C are maintained in auxiliary frame 52 and, thereby, stored in primary frame 50, for example as shown in FIG. 13, which illustrates a right side view of endcap header assembly 14 with second end cover 58 removed. In this embodiment, second sign 16B, namely binding 606, is slid into front channel 216 from an open end thereof as generally indicated by arrow A2 in FIG. 12, such that the plurality of panels 600 depend therefrom with free edges 604 of panels 600 being positioned in front channel 244 holding second sign 16B in sign reception track 260 as illustrated in FIG. 13. Third sign 16C, in one embodiment, is slid into sign reception track 264. More specifically, top edge 704 of third sign 16C is slid into back channel 224 and bottom edge 706 of third sign 16C is simultaneously slid into back channel 254 (not shown in FIG. 12, but an end position shown in FIG. 13).

First and second end covers 56 and 58 are coupled to primary frame 50 to enclose ends thereof and cover cavity 95 as well as auxiliary frame 52. More specifically, top tab 302 and bottom tab 304 of each of first and second end covers 56 and 58 are substantially simultaneously or sequentially slid into top slot 100 and bottom slot 108, respectively, with a friction fit to selectively secure each of first and second covers 56 and 689 to primary frame 50. In one example, end panel 300 is sized to extend beyond a back of back wall 70 to also cover coupling means 54 from side viewing. In addition, in one example, upon coupling first and second end covers 56 and 58 to primary frame 50, a surrounding frame 348, collectively defined by side front flanges 306 of first and second end covers 56 and 58 and bottom front flange 78 and top front flange 76 of primary frame 50, is formed around an opening to cavity 95 providing a clean edge presentation to consumers. By having auxiliary frame 52 stored in primary frame 50 even during non-use, a store employee can quickly change the sign 16A, 16B, 16C and/or utilize auxiliary frame 52 and/or signs 16B and 16C without needing to search for the same.

Figure 14:
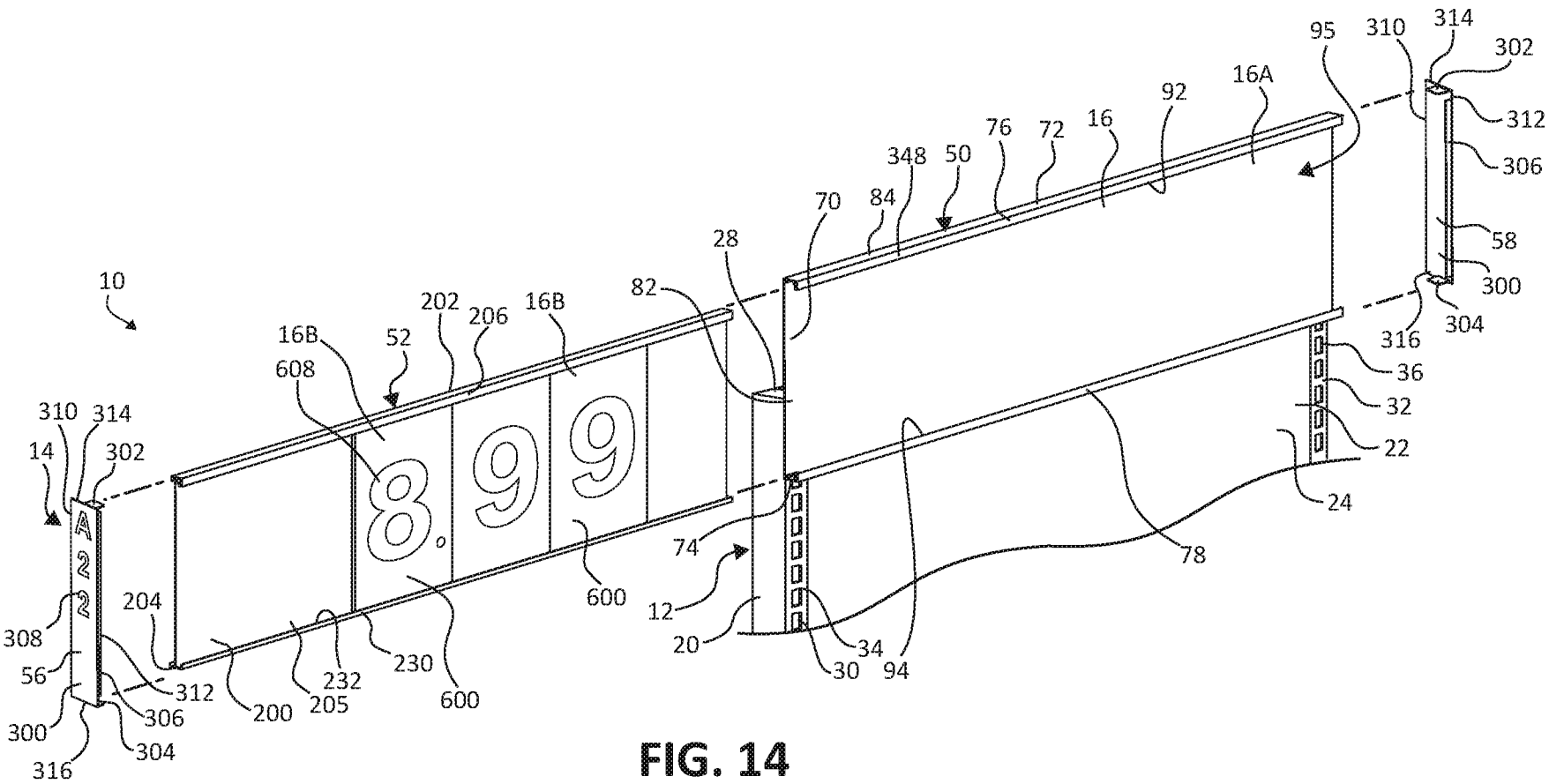
FIG. 14 is front, perspective, partially exploded view illustration of the display system of FIG. 1 including the endcap header assembly in a second configuration, according to one embodiment of the present invention.
Figure 15:
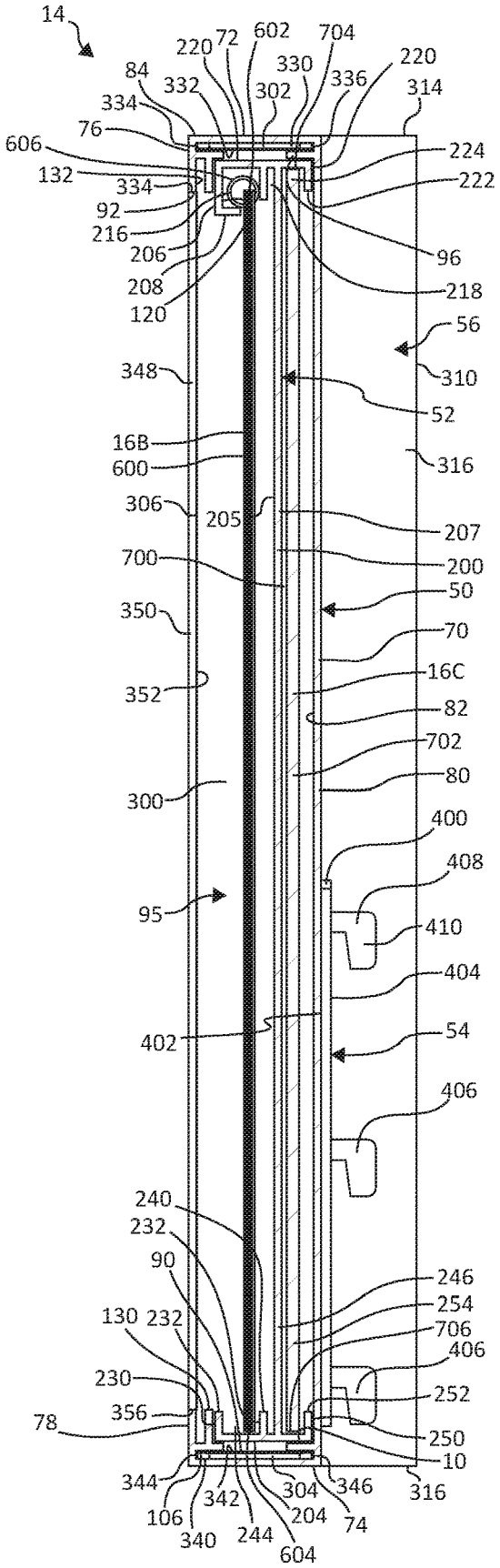
FIG. 15 is the cross-sectional illustration of the endcap header assembly of FIG. 10 with signs added thereto in accordance with FIG. 14, according to one embodiment of the present invention.
Figure 16:
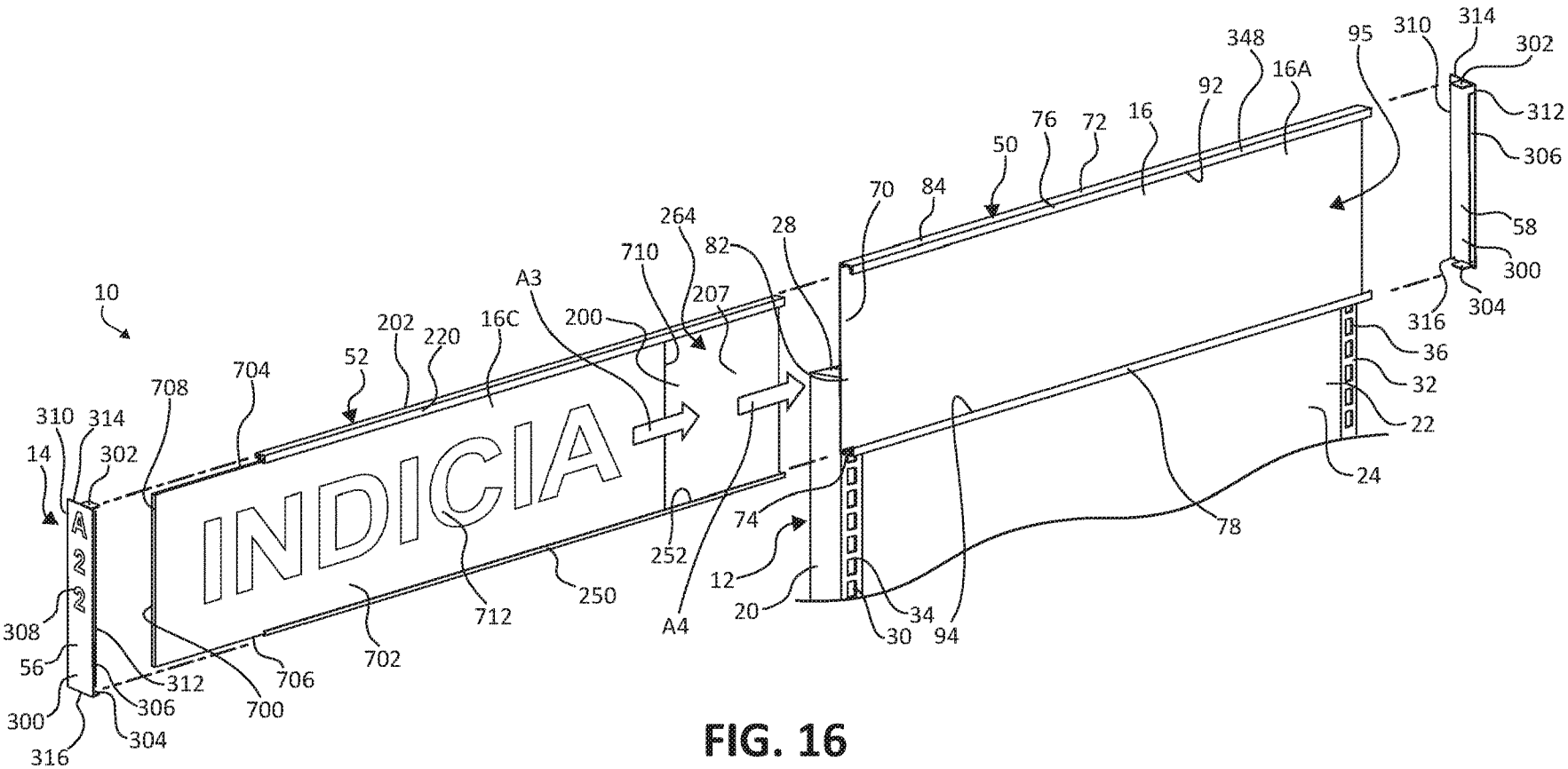
FIG. 16 is front, perspective, partially exploded view illustration of the display system of FIG. 1 including the endcap header assembly in a third configuration, according to one embodiment of the present invention.
Figure 17:
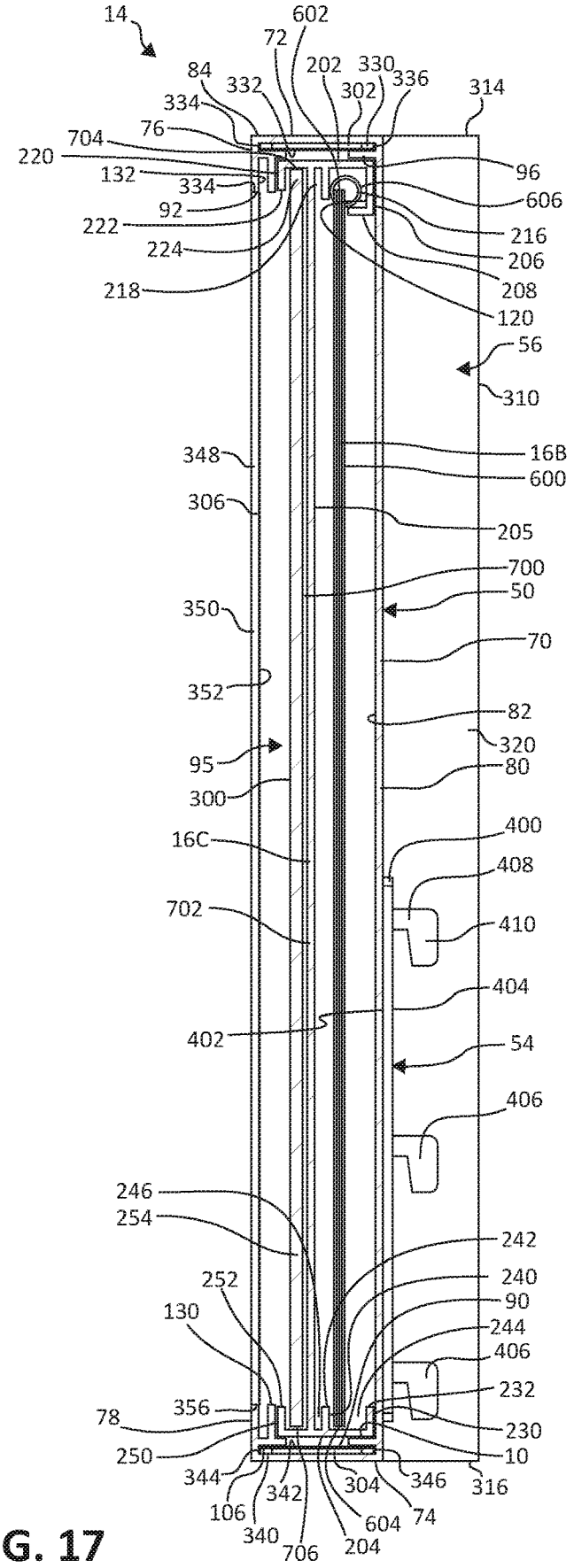
FIG. 17 is the cross-sectional illustration of the endcap header assembly of FIG. 10 with signs added thereto in accordance with FIG. 16, according to one embodiment of the present invention.

For example, to change the presentation of endcap header assembly 14, in one embodiment, one of first and second end covers 56 and 587 are removed and first sign 16A is simply slid out of sign reception track 140, exposing panels 600 of second sign 16B through auxiliary frame 52 as illustrated with reference to FIGS. 14 and 15. In one embodiment, second sign 16B is also slid out of sign reception track 260 and/or panels 600 rotated around binding 606 to change the indicia 608 presented to viewers. In one embodiment, auxiliary frame 52 is slid out of primary frame 50, is flipped, and slid back into sign holder track 142 of primary frame 50, as generally indicated by arrow A4, such that sign reception track 260 faces a back of primary frame 50 (see FIG. 17) and sign reception track 264 faces the front of primary frame 50 as illustrated in FIGS. 16 and 17. In one example, when auxiliary frame 52 is slid out of primary frame 50, if desired, third sign 16C can be replaced, flipped, etc. and slid back into sign reception track 264 as generally indicated by arrow A3 in FIG. 16. In this manner, third sign 16C is now exposed for viewing through frame 348 as illustrated in FIG. 17. Although not illustrated, in one example, another sign 16 or first sign 16A is able to be stored in sign reception track 264 for storage, and in one example, for viewing where no sign 16 is included in sign reception track 260. Other adaptions and conversions to show various signs 16 displayed by endcap header assembly 14 are also contemplated and will be apparent to those of skill in the art upon reading this application. In this manner, endcap header assembly 14 is readily reconfigurable to present various viewing options of various types of signs while also providing for self-storage of components thereof during periods when such components are not in use and/or visible to viewers.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. An endcap header assembly configured to be coupled to a retail display structure, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall; and an auxiliary frame slidable maintained within the sign holder reception track, the auxiliary frame including a primary panel, a top panel extending across a top of the primary panel, and a bottom panel extending across a bottom of the primary panel;

wherein:

the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, the auxiliary frame includes a third sign reception track between the first sign reception track and the second sign reception track, and each of the first sign reception track, the second sign reception track, and the third sign reception track longitudinally extend substantially parallel with one another.

2. The endcap header assembly of claim 1, additionally comprising a sign slidably received in one of the first auxiliary sign reception track and the second auxiliary sign reception track.

3. The endcap header assembly of claim 2, wherein:

the sign is a first sign slidably received in the first auxiliary sign reception track, and the endcap header assembly further comprising a second sign slidably received in the second auxiliary sign reception track.

4. The endcap header assembly of claim 1, further comprising coupling means extending rearwardly from the back wall for selective coupling with a retail display fixture.

5. The endcap header assembly of claim 4, in combination with the retail display fixture.

6. The endcap header assembly of claim 4, in combination with the retail display fixture and products offered for sale and selectively maintained on the retail display fixture.

7. The endcap header assembly of claim 1, wherein the sign reception track is open to a side opposite the back wall.

8. The endcap header assembly of claim 1, further comprising at least two auxiliary signs, wherein:

the auxiliary frame supports at least two auxiliary signs extending substantially parallel to each other, and the at least two auxiliary signs includes a first sign slidably received with the first auxiliary sign reception track and a second sign slidably received within the second auxiliary sign reception track.

9. An endcap header assembly configured to be coupled to a retail display structure, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall; and an auxiliary frame slidable maintained within the sign holder reception track, the auxiliary frame including a primary panel, a top panel extending across a top of the primary panel, and a bottom panel extending across a bottom of the primary panel; and wherein:

the top panel and the bottom panel collectively define a first auxiliary sign reception track on a first side of the primary panel and a second auxiliary sign reception track on a second side of the primary panel, the endcap header assembly further comprises:

a first sign slidably received in the first auxiliary sign reception track; and a second sign slidably received in the second auxiliary sign reception track;

the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, and the first sign includes a plurality of panels coupled via a spiral binding and the second sign is planar sign characterized by an absence of any spiral binding.

10. An endcap header assembly configured to be coupled to a retail display structure, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall; and an auxiliary frame slidable maintained within the sign holder reception track, the auxiliary frame including a primary panel, a top panel extending across a top of the primary panel, and a bottom panel extending across a bottom of the primary panel;

wherein the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, and the primary frame includes a primary sign reception track in front and extending substantially parallel to the sign holder reception track.

11. The endcap header assembly of claim 10, further comprising a sign slidably received within the primary sign reception track, the sign substantially covering a front side of the auxiliary frame from view.

12. An endcap header assembly configured to be coupled to a retail display structure, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall; and an auxiliary frame slidable maintained within the sign holder reception track, the auxiliary frame including a primary panel, a top panel extending across a top of the primary panel, and a bottom panel extending across a bottom of the primary panel;

an end cap including an end panel, a top tab extending from near a top edge of the end panel in a first direction, and a bottom tab extending from near a bottom edge of the end panel in the first direction;

wherein:

the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, the primary frame defines a top slot extending substantially horizontally over the sign holder reception track and a bottom slot extending substantially horizontally beneath the sign holder reception track, and the top tab is friction fit within the top slot and the bottom tab is friction fit within the bottom slot to couple the end cap to the primary frame covering an end of the primary frame and an end of the auxiliary frame stored within the primary frame.

13. The endcap header assembly of claim 12, wherein the end cap includes a front flange at least partially extend over an opening of the primary frame opposite the back wall to collectively form a frame around the opening with a top flange and a bottom flange of the primary frame.

14. An endcap header assembly configured to be coupled to a retail display structure, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall;

an auxiliary frame slidable maintained within the sign holder reception track, the auxiliary frame including a primary panel, a top panel extending across a top of the primary panel, and a bottom panel extending across a bottom of the primary panel;

at least two auxiliary signs; and a primary sign, wherein:

the auxiliary frame supports at least two auxiliary signs extending substantially parallel to each other, the at least two auxiliary signs includes a first sign slidably received with the first auxiliary sign reception track and a second sign slidably received within the second auxiliary sign reception track, the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, the primary frame includes a primary sign reception track in front and extending substantially parallel to the sign holder reception track, and the primary sign is slidably received with the primary sign reception track to cover the auxiliary frame when the endcap header assembly is viewed from a side opposite the back wall.

15. A display system comprising:

a retail display fixture; and an endcap header assembly coupled to the retail display fixture, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall, and an auxiliary frame slidable maintained within the sign holder reception track, the auxiliary frame including a primary panel, a top panel extending across a top of the primary panel, and a bottom panel extending across a bottom of the primary panel, wherein the top panel and the bottom panel collectively define a first auxiliary sign reception track on a first side of the primary panel and a second auxiliary sign reception track on a second side of the primary panel, Hand lithe auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, and the primary frame includes a primary sign reception track in front and extending substantially parallel to the sign holder reception track.

16. The display system of claim 15, wherein:

the endcap header assembly further comprises at least two auxiliary signs, the auxiliary frame supports at least two auxiliary signs extending substantially parallel to each other, and the at least two auxiliary signs includes a first sign slidably received with the first auxiliary sign reception track and a second sign slidably received within the second auxiliary sign reception track.

17. A display system comprising:

a retail display fixture; and an endcap header assembly coupled to the retail display fixture, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall, and an auxiliary frame slidable maintained within the sign holder reception track, the auxiliary frame including a primary panel, a top panel extending across a top of the primary panel, and a bottom panel extending across a bottom of the primary panel, wherein:

the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, the auxiliary frame includes a third sign reception track between the first sign reception track and the second sign reception track, and each of the first sign reception track, the second sign reception track, and the third sign reception track longitudinally extend substantially parallel with one another.

18. A display system comprising:

a retail display fixture; and an endcap header assembly coupled to the retail display fixture, the endcap header assembly comprising:

a primary frame including a back wall, a top wall extending forwardly from the back wall, and a bottom wall extending forwardly from the back wall opposite the top wall to define a sign holder reception track in front of the back wall and at least partially open opposite the back wall, and an auxiliary frame slidable maintained within the sign holder reception track, the auxiliary frame including a primary panel, a top panel extending across a top of the primary panel, and a bottom panel extending across a bottom of the primary panel, an end cap including an end panel, a top tab extending from near a top edge of the end panel in a first direction, and a bottom tab extending from near a bottom edge of the end panel in the first direction;

wherein:

the top panel and the bottom panel collectively define a first auxiliary sign reception track on a first side of the primary panel and a second auxiliary sign reception track on a second side of the primary panel, the auxiliary frame is configured to be slidably received within the sign holder reception track in a first configuration wherein the first auxiliary sign reception track is closer to the back wall than the second auxiliary sign reception track and a second configuration wherein the second auxiliary sign reception track is closer to the back wall than the first auxiliary sign reception track, the primary frame defines a top slot extending substantially horizontally over the sign holder reception track and a bottom slot extending substantially horizontally beneath the sign holder reception track, and the top tab is friction fit within the top slot and the bottom tab is friction fit within the bottom slot to couple the end cap to the primary frame covering an end of the primary frame and an end of the auxiliary frame stored within the primary frame.

* * * * *